US007093995B1

(12) United States Patent
Chan

(10) Patent No.: US 7,093,995 B1
(45) Date of Patent: Aug. 22, 2006

(54) COTTON BUD HEAD

(75) Inventor: Li-Chun Chan, Taichung (TW)

(73) Assignee: Shya Hsin Plastic Works Co., Ltd., Taichung (TW)

( * ) Notice: Subject to any disclaimer, the term of this patent is extended or adjusted under 35 U.S.C. 154(b) by 0 days.

(21) Appl. No.: 11/242,030

(22) Filed: Oct. 4, 2005

(51) Int. Cl.
*B43K 1/06* (2006.01)

(52) U.S. Cl. ..... 401/265; 401/263; 401/183; 401/186

(58) Field of Classification Search ..... 401/265, 401/263, 266, 183, 186, 25–27; 222/209, 222/213
See application file for complete search history.

(56) References Cited

U.S. PATENT DOCUMENTS 3,087,656 A * 4/1963 Dougherty ..... 222/213
3,141,580 A * 7/1964 Rogers ..... 222/213
4,457,453 A * 7/1984 Stevens et al. ..... 222/213
4,867,593 A * 9/1989 Kurokawa et al. ..... 401/186
6,409,406 B1 * 6/2002 Schwartzman ..... 401/186

FOREIGN PATENT DOCUMENTS

JP 03215099 A * 9/1991 ..... 401/196

* cited by examiner

*Primary Examiner*—Khoa D. Huynh
(74) *Attorney, Agent, or Firm*—Leong C. Lei

(57) ABSTRACT

An improved structure of a cotton bud head is disclosed. The cotton bud head comprises a storage tube for the containing of cosmetics and a brush head for the application of cosmetics, characterized in that the body of the cotton bud head is made from silica gel material by ejection molding and the bottom section of the cotton bud head is covered by an inner and outer seat made from a plastic material and the silica gel hollow storage tube inserted with a guiding rod such that the two ends of the guiding tube are formed into a conic head to guide the flow of cosmetic to provide fixed amount and evenly flow of cosmetic to the external end face of the silica gel for application.

1 Claim, 6 Drawing Sheets

COTTON BUD HEAD

BACKGROUND OF THE INVENTION (a) Technical Field of the Invention

The present invention relates to head structure of a cotton bud, and in particular, an improved structure of a cotton bud head made from a silica gel and having a central through hole and a guiding rod such that liquid cosmetic can be evenly flown to the cotton bud head for application.

(b) Description of the Prior Art

FIGS. 5 and 6 show conventional cotton bud head structure having a cotton head body 20 made from a plastic molded feeding tube 21 and a securing seat 22 covered with a cotton fabric 23 or a directly mounted fabric such that the entire cotton bud structure contains cosmetic fluid.

The driving mechanism at the lower section of the tube body squeezes out the content to the feeding tube 21 and then to the tube mouth section. When the cotton fabric 23 is wet with cosmetic, it is not easy to control the amount of cosmetic to be applied and therefore evenly applying of cosmetic is difficult. Further, the cotton fabric 23 is easily dislocated and the cosmetic on the fabric 23 is hardens after a period of time.

In view of the above, it is an object of the present invention to provide an improved structure of a cotton bud head, which can mitigate the above drawback.

SUMMARY OF THE INVENTION

The primary purpose of the present invention is to provide an improved structure of a cotton bud head, the body of the cotton bud head is made from silica gel material by ejection molding and the bottom section of the cotton bud head is covered by an inner and outer seat made from a plastic material and the silica gel hollow storage tube inserted with a guiding rod such that the two ends of the guiding tube are formed into a conic head to guide the flow of cosmetic to provide fixed amount and evenly flow of cosmetic to the external end face of the silica gel for application.

Yet still another object of the present invention is to provide an improved structure of a cotton bud head, wherein the guiding rod is suspended and the bottom end thereof is directly secured to the internal ring seat of the bottom end of the body of the cotton bud head, and one outlet end has a conic head which is closely adhered to the inner edge of the outlet.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
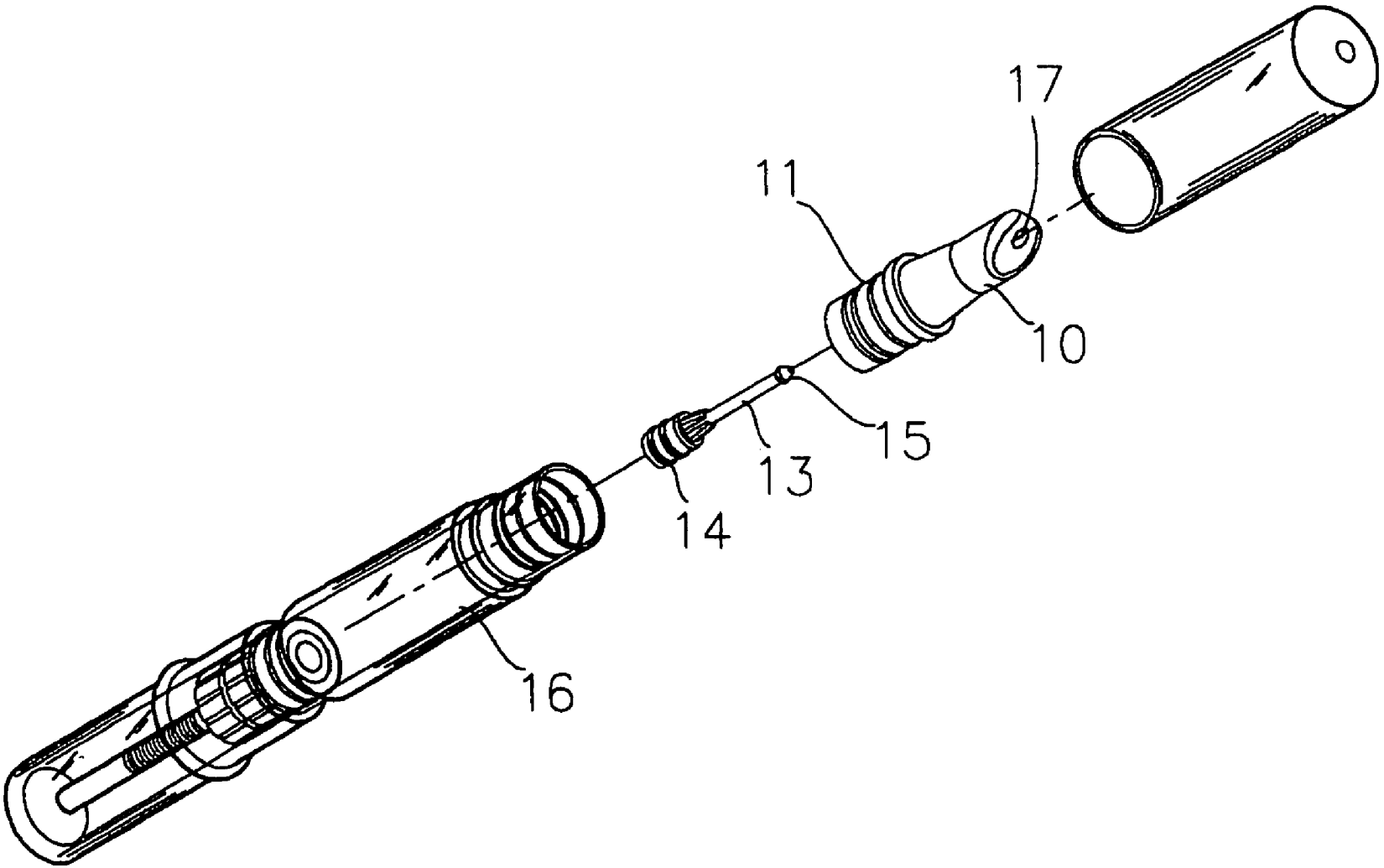
FIG. 1 is an exploded perspective view of an improved structure of a cotton bud head in accordance with the present invention.
Figure 2:
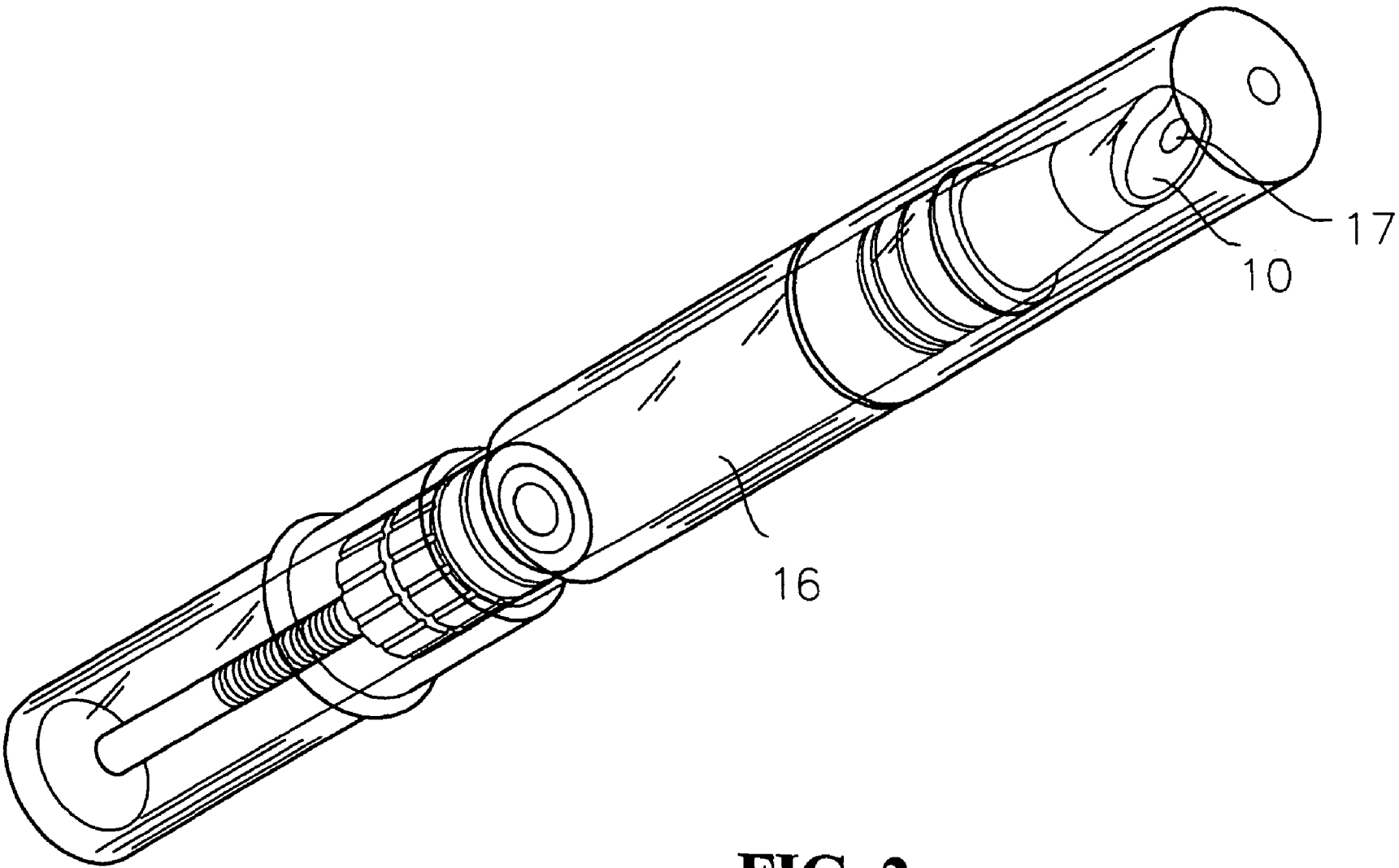
FIG. 2 is a perspective view of an improved structure of a cotton bud head of the present invention.
Figure 3:
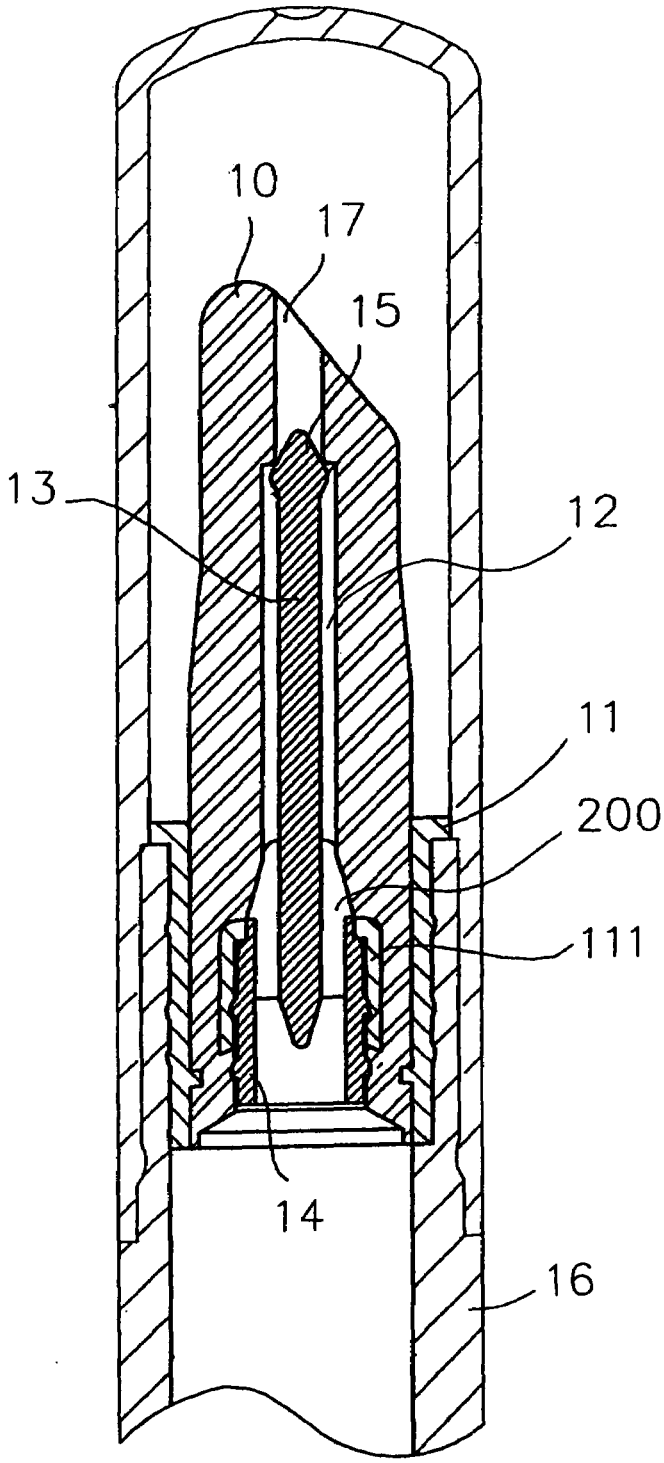
FIG. 3 is a sectional view of an improved structure of a cotton bud head of the present invention.
Figure 4:
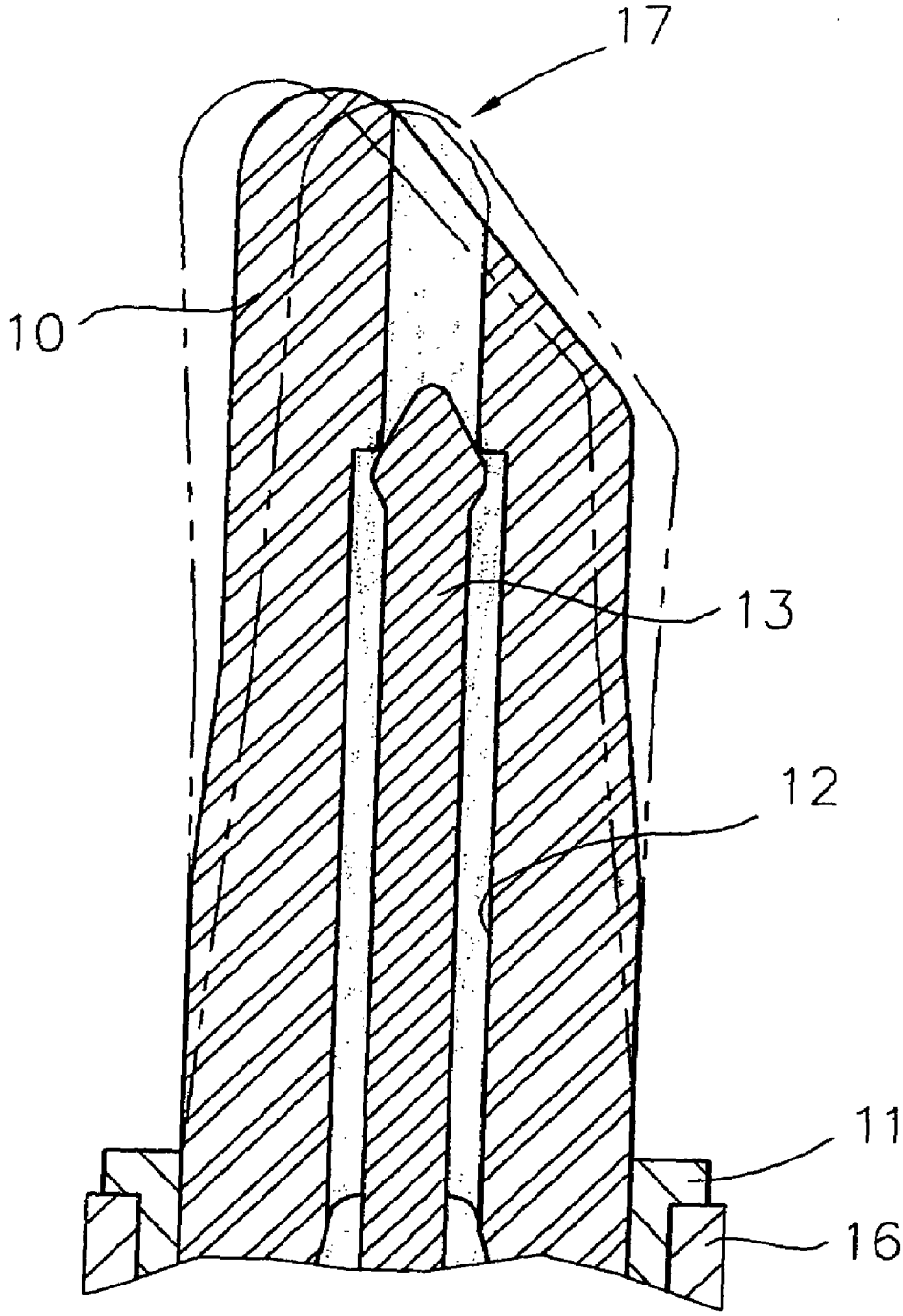
FIG. 4 is a schematic view showing the cotton bud head covered with cosmetic in accordance with the present invention.
Figure 5:
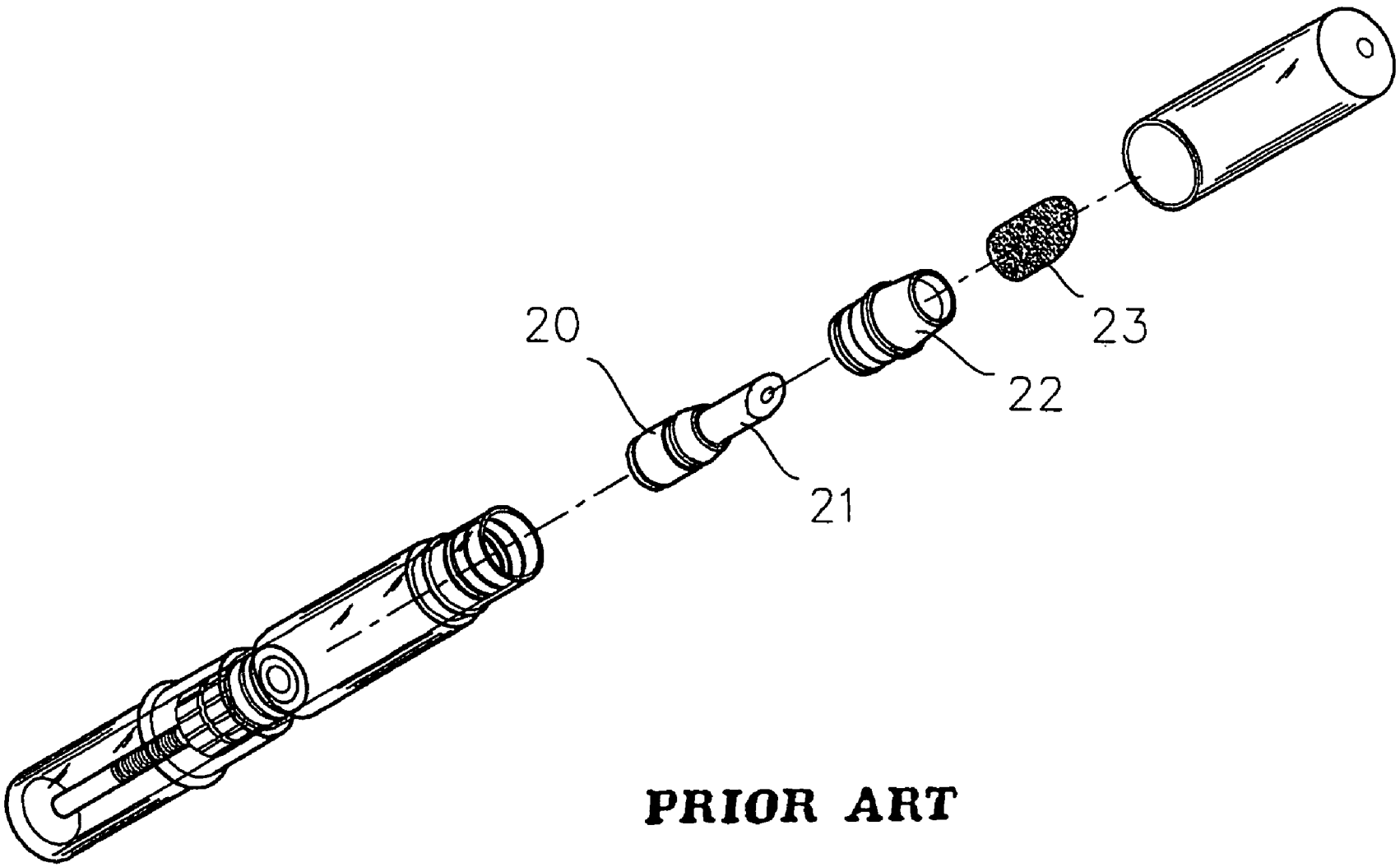
PRIOR ART FIG. 5
FIG. 5 is a perspective exploded view of a conventional cotton bud head.
Figure 6:
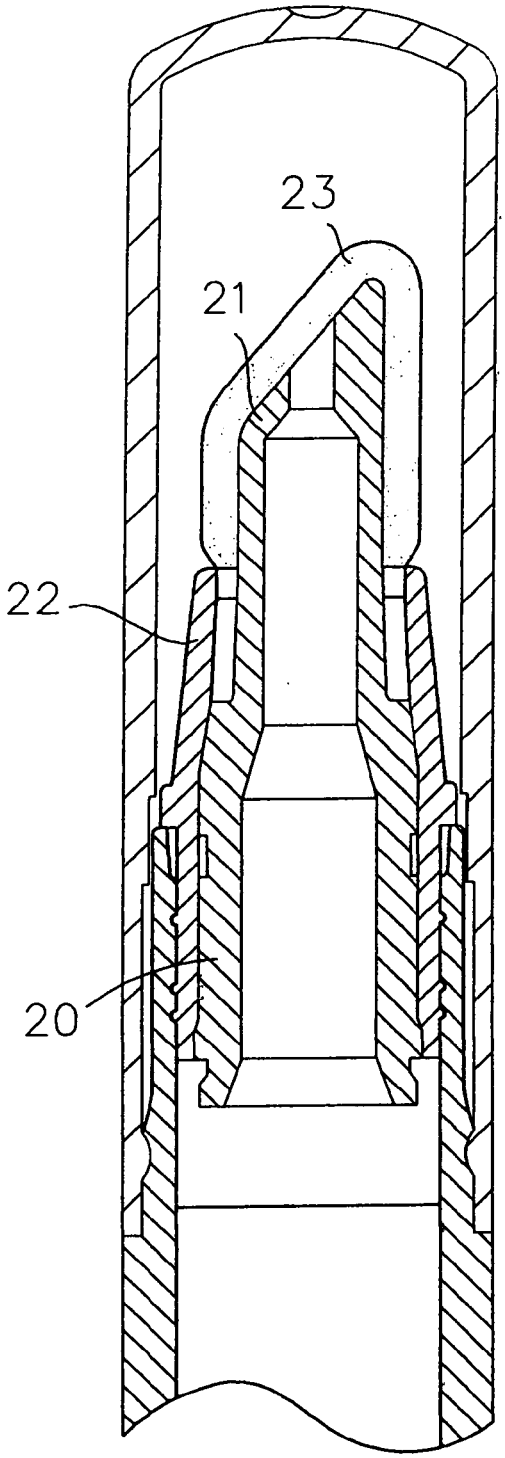
PRIOR ART FIG. 6
FIG. 6 is a sectional view showing the conventional cotton bud head.

In accordance with the present invention, there is shown an improved structure of a cotton bud head which shown in FIG. 4, having a cotton bud head body 10 made from silica gel material. The body 10 is soft and has a smooth surface. The inner and external ring surfaces at the bottom end of the body 10 are engaged with inner and external ring seats 11, 111 respectfully. A storage tube 16 has an upper end mounted on the external ring seat 11 for containing cosmetic material. The center of the body 10 has a storage cavity 12 which is stepped and the flow rate and flowing of cosmetic are smoothly controlled. The center of the storage cavity 12 is inserted with a guiding rod 13 which has a lower end fitted between a plurality of ribs 200 which are mounted on a bottom seat. One end of the bottom seat 14 is tubular and is directly inserted to the inner ring seat 111 of the bottom end of the body 10, forming into a cosmetic flow guiding and cosmetic flow branching and the cosmetic can be smoothly flow to the storage cavity 12 of the body 10. The cosmetic flows through the guiding rod 13 to the conical head 15 such that the ring edge of the guiding rod 13 will slightly touch the outlet 17 at the end head of the body 10 are slightly touching the ring face. By means of the conical head 15, when the cosmetic fluid is squeezed out, the cosmetic will flow smoothly and steadily to the edge face at the top end of the body of the cotton bud head 10. This will facilitate application of the cosmetic. If the structure is releasing from squeezing, the conic head 15 of the guiding rod 13 will be restored and the outlet 17 is automatically closed. Thus the flowing out of the cosmetic is stopped.

One advantage of the cotton bud head being made from silica gel is that the body of the cotton bud head can be made as one unit. Further, the cosmetic will not be adhered to the head structure and therefore excessive cosmetics will not be squeezed out. In accordance with the present invention, the flow rate of the cosmetic can be easily controlled.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a cotton bud head comprising:

a head body made from silica gel material, said head body being soft and having a smooth surface, said body having a center formed with a stepped storage cavity;

an external ring seat mounted on an external ring surface at a bottom end of said head body;

an inner ring seat mounted on an inner ring surface at said bottom end of said head body;

a storage tube having an upper end mounted on said external ring seat for containing liquid cosmetic material;

a guiding rod inserted into said storage cavity of said head body and having a lower end fitted between a plurality of ribs which are mounted on a bottom seat, one end of the bottom seat being tubular and being directly inserted to said inner ring seat thereby enabling said liquid cosmetic material to flow to said storage cavity, said guiding rod having a conical head which slightly touch an outlet of said stepped storage cavity.

* * * * *